United States Patent [19]

Suzuki

[11] Patent Number: 4,848,101

[45] Date of Patent: Jul. 18, 1989

[54] METHOD AND SYSTEM FOR CONTROLLING CAPACITY OF VARIABLE CAPACITY WOBBLE PLATE COMPRESSOR

[75] Inventor: Nobuhiko Suzuki, Konan, Japan

[73] Assignee: Diesel Kiki Co., Ltd., Japan

[21] Appl. No.: 160,307

[22] Filed: Feb. 25, 1988

Related U.S. Application Data

[62] Division of Ser. No. 26,053, Mar. 16, 1987, abandoned.

[30] Foreign Application Priority Data

Mar. 19, 1986 [JP] Japan ..... 61-063401
Jun. 27, 1986 [JP] Japan ..... 61-152153

[51] Int. Cl.[4] ..... F25B 1/00
[52] U.S. Cl. ..... 62/228.5; 62/196.3; 251/129.08
[58] Field of Search ..... 62/228.5, 196.3, 228.1; 251/129.05, 129.08; 236/46 F

[56] References Cited

U.S. PATENT DOCUMENTS 4,102,150 7/1978 Kountz ..... 62/209

FOREIGN PATENT DOCUMENTS 0208256 1/1987 European Pat. Off. ..... 236/46 F

*Primary Examiner*—Harry B. Tanner
*Attorney, Agent, or Firm*—Charles S. McGuire

[57] ABSTRACT

A method of controlling the capacity of a variable capacity wobble plate compressor from an air conditioning system wherein the compressor capacity is controlled such that the degree of communication between a suction chamber and a crankcase is controlled by a pressure control valve to vary the crankcase pressure and hence the angularity of the wobble plate. The value of at least one parameter representing thermal load is detected, the magnitude of current to be supplied to an electromagnetic actuator of the pressure control valve is determined in response to the detected parameter value, and the opening of the pressure control valve is determined in response at least to the determined magnitude of current.

1 Claim, 7 Drawing Sheets

METHOD AND SYSTEM FOR CONTROLLING CAPACITY OF VARIABLE CAPACITY WOBBLE PLATE COMPRESSOR

REFERENCE TO RELATED APPLICATION

This application is a division of copending application Ser. No. 26,053 filed Mar. 16, 1987 abandoned.

BACKGROUND OF THE INVENTION

This invention relates to a method and system for controlling the capacity or delivery quantity of a variable capacity wobble plate compressor adapted for compressing refrigerant gas recirculated in air conditioning systems for automotive vehicles.

Conventionally, a variable capacity wobble plate compressor has been known which is equipped with an electromagnetic valve for opening and closing a passage communicating a suction chamber with a crankcase, and arranged such that the degree of communication between the suction chamber and the crankcase is controlled through control of the opening degree of the electromagnetic valve to vary the pressure in the crankcase, whereby the angularity of a wobble plate is varied to change the stroke of pistons to thereby vary the capacity or delivery quantity. However, according to the compressor constructed as above, the opening control of the electromagnetic valve is conducted in response only to the output from a humanly operated temperature setting device. However, in actuality, the suction pressure varies with a change in the thermal load and there occurs a pressure loss (as a function of the flow rate of refrigerant) between the outlet of the evaporator and the inlet of the compressor, so that the evaporator is frozen and, as a result, a required cooling rate is not obtained.

When the thermal load varies, the suction pressure also varies accompanying a change in the evaporator boiling pressure whereby the desired evaporator boiling pressure may not be obtained. The evaporator boiling temperature changes with the evaporator boiling pressure, so that, for example, when the thermal load decreases the evaporator freezes, and, on the other hand, when the thermal load increases the required cooling performance cannot be obtained.

SUMMARY OF THE INVENTION

It is an object of the invention to provide a method and system for controlling the capacity of a variable capacity wobble plate compressor for an air conditioning system such that desired cooling performance is always obtained irrespective of a variation in thermal load on the system.

According to the invention, there is provided a method of controlling the capacity of a variable capacity wobble plate compressor for an air conditioning system, the compressor having a crankcase, a wobble plate arranged within the crankcase, pistons disposed for reciprocating motion through a stroke determined by the angularity of the wobble plate, a suction chamber, a communication passage for communicating the suction chamber with the crankcase, and a pressure control valve having a valve body disposed to open and close the communication passage and an electromagnetic actuator for controlling the opening of the valve body, wherein the capacity of the compressor is controlled in a manner such that the degree of communication between the suction chamber and the crankcase is controlled in response to the opening degree of the pressure control valve to vary pressure within the crankcase for varying the angularity of the wobble plate and hence vary the stroke of the pistons to thereby vary the capacity of the compressor.

The method is characterized by comprising the following steps:

(1) detecting the value of at least one parameter representing thermal load on the air conditioning system;

(2) determining the magnitude of current to be supplied to the electromagnetic actuator in response to the detected value of the parameter; and (3) determining the opening of the pressure control valve in response at least to the determined magnitude of the current.

The present invention further provides a system for controlling the capacity of a variable capacity wobble plate compressor for an air conditioning system, the compressor having a crankcase, a wobble plate arranged within the crankcase, pistons disposed for reciprocating motion through a stroke determined by the angularity of the wobble plate, a suction chamber, a communication passage for communicating the suction chamber with the crankcase, and a pressure control valve having a valve body disposed to open and close the communication passage and an electromagnetic actuator having a solenoid for controlling the opening of the valve body in response to current supplied to the solenoid, wherein the capacity of the compressor is controlled in a manner such that the degree of communication between the suction chamber and the crankcase is controlled in response to the opening degree of the pressure control valve to vary pressure within the crankcase for varying the angularity of the wobble plate and hence vary the stroke of the pistons to thereby vary the capacity of the compressor.

The system is characterized by comprising the following components: a power source for supplying a predetermined constant voltage; a temperature sensor for detecting the value of a parameter representing a thermal load on the air conditioning system, the sensor assuming a resistance value corresponding to the detected value of the parameter; temperature setting means adapted to assume a resistance value corresponding to a desired set temperature to which the temperature of a space to be conditioned by the air conditioning system is controlled, the temperature sensor and the temperature setting means being connected in series between the power source and ground; and current control means connected to the junction of the temperature sensor and the temperature setting means and to the solenoid of the electromagnetic actuator, for supplying the solenoid with current amount corresponding to the voltage at the junction.

Further, according to another embodiment of the invention, the system comprises the following components: signal generating means for generating an output signal having a predetermined frequency; pulse conversion means for converting the output signal from the signal generating means into output pulses having a constant amplitude and a predetermined duty ratio; level conversion means for setting the amplitude of the output pulses from the pulse conversion means to a value corresponding to the value of a parameter representing a thermal load on the air conditioning system; and driving means for supplying the electromagnetic actuator with driving output pulses corresponding to output from the level conversion means. By virtue of this construction of the system, therefor hysteresis phenomenon is eliminated.

The above and other objects, features and advantages of the invention will be more apparent from the ensuing detailed description taken in conjunction with the accompanying drawings.

DETAILED DESCRIPTION

The invention will now be described in detail with reference to the drawings showing embodiments thereof.

Figure 1:
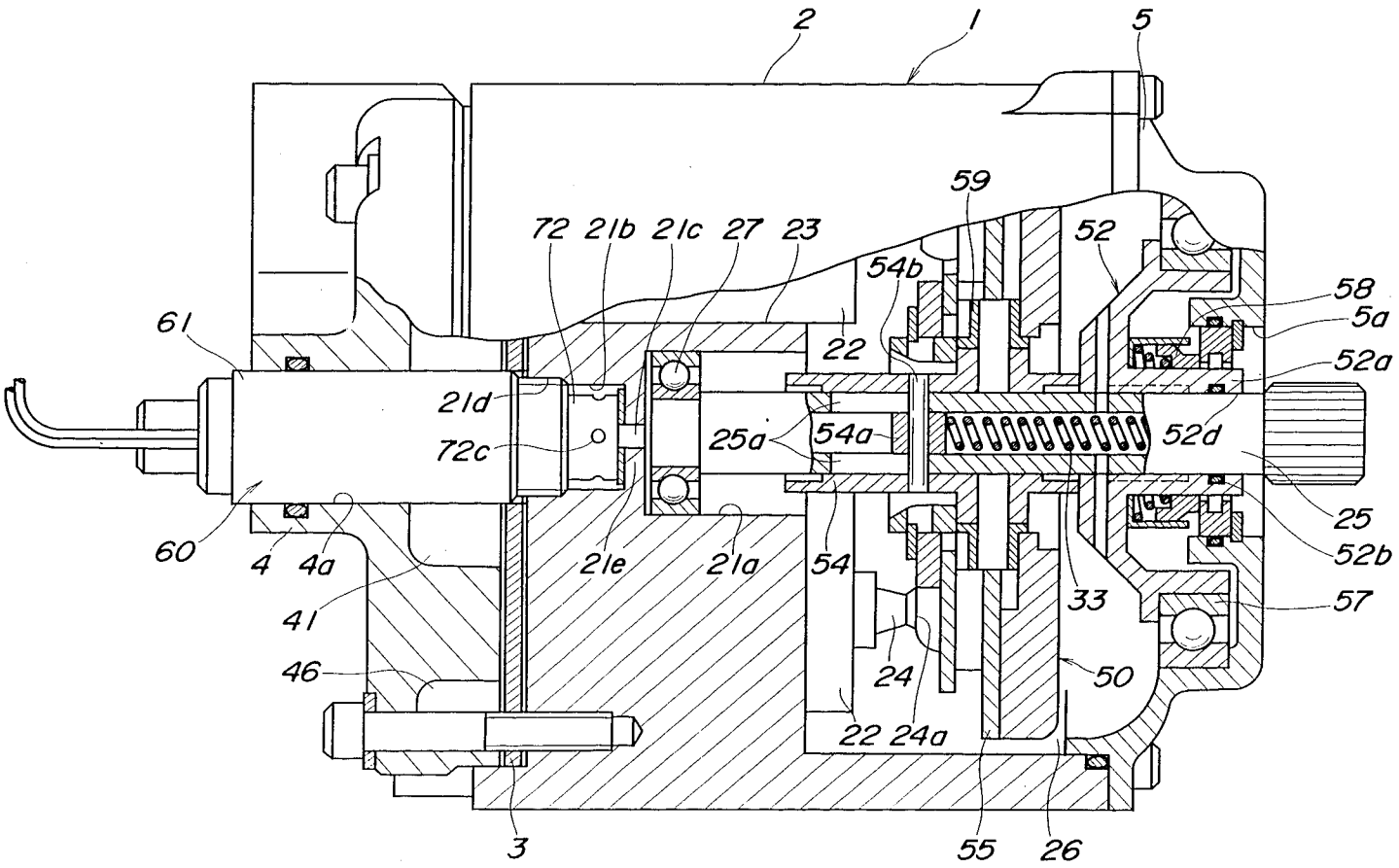
FIG. 1 is a horizontal longitudinal sectional view showing the whole arrangement of a variable capacity wobble plate compressor to which is applied the invention.
Figure 2:
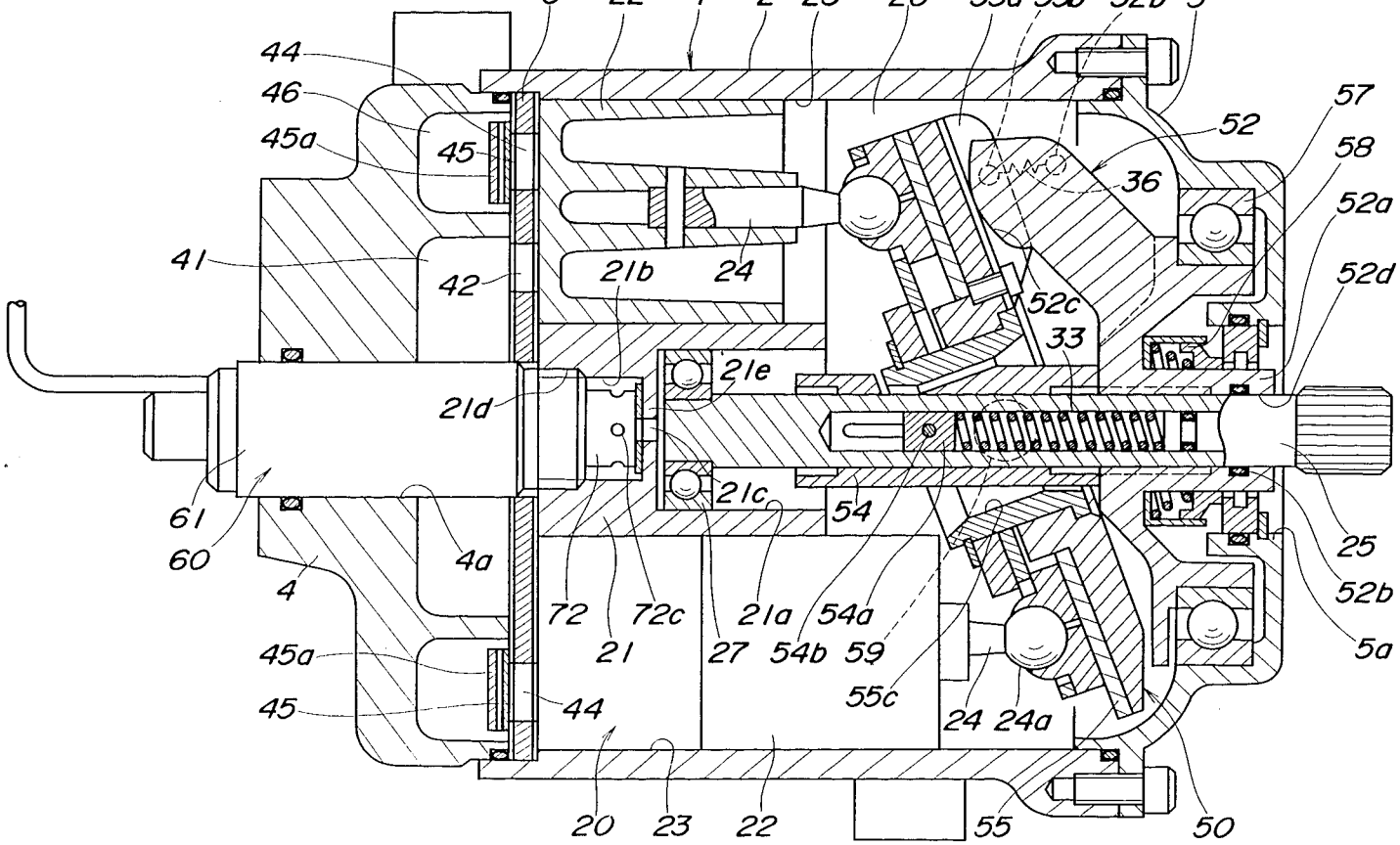
FIG. 2 is a vertical longitudinal sectional view of the same compressor.

Referring first to FIGS. 1 and 2, there is shown the whole construction of a variable capacity wobble plate compressor to which is applied the invention.

Reference numeral 1 designates a housing which is formed by a cylindrical casing 2, a cylinder head 4 mounted in airtight manner on an end face (the left end face in the figures) of the casing 2 via a valve plate 3, and a head member 5 mounted in airtight manner on the other end face (the right end face in the figures) of the casing 2.

The cylinder head 4 has a dished and generally cylindrical configuration, in which a pressure control valve 60, hereinafter described, is provided at its diametrical center. In the cylinder head 4, a suction chamber 41 is formed around the pressure control valve 60, and a discharge chamber 46 is formed radially outward of the suction chamber 41. The suction chamber 41 and the discharge chamber 46, which are thus concentrically arranged and annular in shape, are defined by one end of the valve plate 3 to which one end face of the cylinder head 4 is attached in airtight manner via a sealing member, not shown.

The suction chamber 41 is connected to an outlet of an evaporator (not shown) of a refrigerating cycle of the air conditioning system via a suction port (not shown), while the discharge chamber 46 is connected to an inlet of a condenser of the refrigerating cycle via a discharge port (not shown).

A cylinder-piston mechanism 20 for compressing the refrigerant is arranged within the casing 2 at a side of the valve plate 3 remote from the cylinder head 4. The cylinder-piston mechanism 20 is composed of a cylinder block 21 and pistons 22.

The cylinder block 21 is formed integrally with the casing 2, and has a central bore 21*a* formed therein along an axis thereof to receive a drive shaft 25 of a piston driving mechanism 50, hereinafter described. A plurality of cylinders 23 are formed in the cylinder block 21 with their axes parallel to the axis of the cylinder block 21 and in circumferentially equidistant arrangement.

The pistons 22 are slidably received within respective ones of the cylinders 23. A piston rod 24 is connected at its one end to each piston 22, and a ball joint 24*a* is formed at the other end of each piston rod 24.

Formed through the valve plate 3 are a plurality of inlet openings 42, each for communicating the suction chamber 41 with the respective cylinder 23, and a plurality of outlet openings 44, each for communicating the discharge chamber 46 with the respective cylinder 23. A discharge valve 45 and a discharge valve retainer 45*a* are mounted at an open end of each outlet opening 44 (FIG. 2). Also, a suction valve, not shown, is mounted at each inlet opening 42.

With this arrangement, the cylinder-piston mechanism 20 is adapted to suck lower pressure refrigerant from the suction chamber 41 into the cylinders 23 via the respective inlet openings 42 and suction valves, compress the refrigerant, and then discharge same into the discharge chamber 46 via the outlet openings 44 and discharge valves 45.

The piston driving mechanism 50 for driving the cylinder-piston mechanism 20 is arranged within a crankcase 26 which is defined within the casing 2 at a side remote from the cylinder block 21 in the housing 1. The piston driving mechanism 50 is composed of the drive shaft 25 extending substantially along the axis of the housing 1, an arm member 52 secured on one end portion of the drive shaft 25, a slider 54 axially slidably fitted on an intermediate portion of the drive shaft 25, and a wobble plate 55 freely fitted on the slider 54 for tilting.

Figure 3:
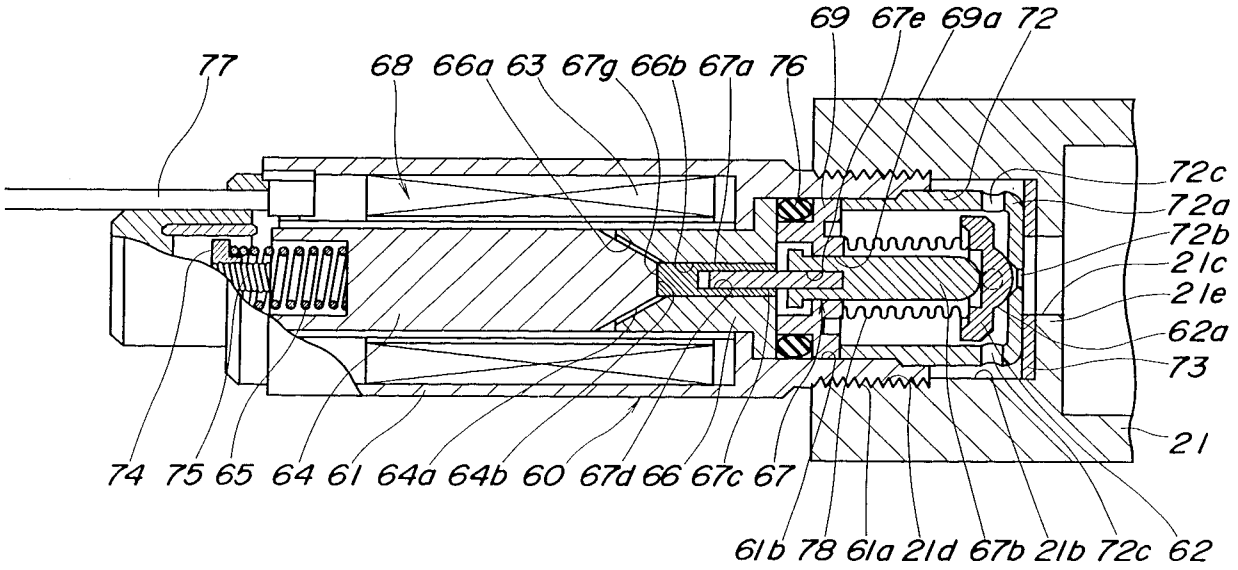
FIG. 3 is a longitudinal sectional view of a pressure control valve provided in the same compressor.
Figure 4:
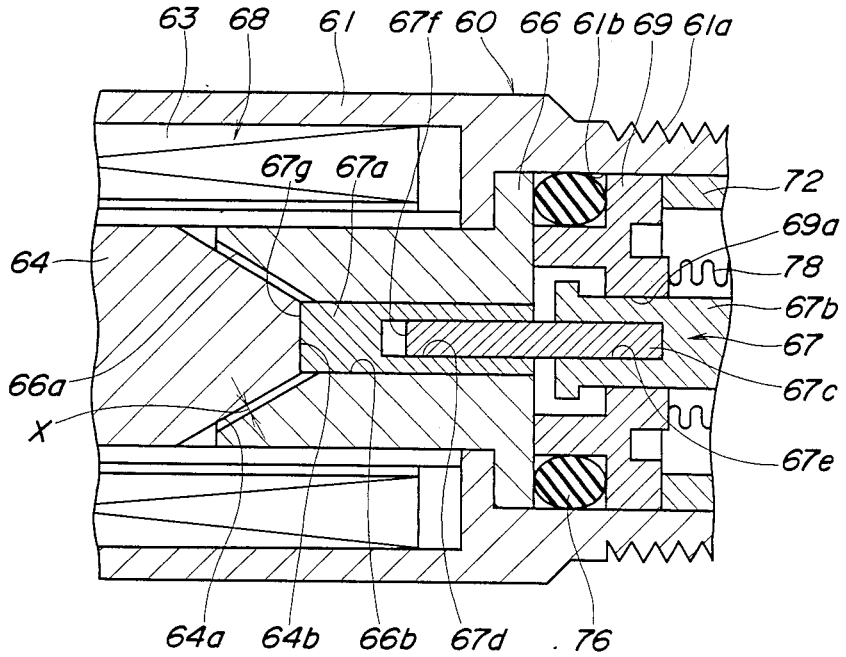
FIG. 4 is an enlarged longitudinal sectional view of essential part of the same pressure control valve.

The drive shaft 25 has the other or left end portion, as viewed in FIGS. 2 and 3, journalled by a radial ball bearing 27 mounted in the central bore 21*a* formed in the cylinder block 21, and has the one or right end portion journalled by a through bore 52*d* formed in the head member 5 via the arm member 52 and a large-sized radial ball bearing 57. The right end portion of the drive shaft 25 also extends through a central bore 5*a* formed in the head member 5 to the outside. Mounted on the exteriorly extended portion of the drive shaft 25 is a magnetic clutch (not shown) which is connected via a driving belt to a pulley on an output shaft of an engine installed in a vehicle, none of which is shown. A mechanical sealing device 58 is interposed between a boss 52*a* of the arm member 52 and an inner wall of the head member 5 which defines the central bore 5*a*, and an O-ring 52*b* between the drive shaft 25 and the boss 52*a* of the arm member 52, so that the crankcase is kept airtight against the outside.

The slider 54, which is in the form of a sleeve, is fitted on the intermediate portion of the drive shaft 25 for axial sliding movement thereon, but is prohibited from rotation relative to the drive shaft 25. Thus, the slider 54 can be rotated together with the drive shaft 25. An internal slider 54*a* is axially slidably fitted within the drive shaft 25 and urged toward the cylinder block 21 by a coiled spring 33 disposed in the drive shaft 25. A cross pin 54b vertically penetrates through the internal slider 45, with its opposite ends radially extending through respective diametrically opposite slots 25a, 25a formed in the drive shaft 25 and fitted into the external slider 54. Thus, the wobble plate 55, which is engaged with the slider 54 as described later, is urged in the angularity-decreasing direction together with the internal slider 54a by the coil spring 33. The wobble plate 55, which is in the form of a disc, is freely fitted on the slider 54 at its central through bore 55c and is joined to an axially middle portion of the slider 54 by means of a pair of trunnion pins 59 at two diametrically opposite points of the inner surface of the central through bore 55c. Consequently, the wobble plate 55 is tiltable about the trunnion pins 59 within a predetermined angle range with respect to the vertical plane to the drive shaft 25.

The wobble plate 55 and the arm member 52 are coupled to each other in the following manner. A side surface of the wobble plate 20 facing the arm member 52 is formed thereon with a pair of guide protuberances 55a radially extending parallel with each other at predetermined locations, as shown in FIG. 2. A pair of coiled springs 36 are connected in taut state between a pair of pins 55b projected from opposite outer side surfaces of the parallel guide protuberances 55a and a pair of pins 42 projected from opposite side surfaces of an upper end portion of the arm member 52. Therefore, the arm member 52 has a camming surface 52c at the tip always kept in urging contact with the above-mentioned side surface of the wobble plate 55.

Pivotably joined to the other side surface of the wobble plate 55 facing toward the pistons 22 are the ball joints 24a of the piston rods 24 of the respective pistons 22. Thus, as the drive shaft 25 rotates, the wobble plate 55 is rotated through the arm member 52. If the wobble plate 55 is then tilted with respect to the vertical line to the drive shaft 25 through a substantial angle, the piston driving mechanism 50 operates in response to rotation of the wobble plate 55 to cause the pistons 22 of the cylinder-piston mechanism 20 to make reciprocating motions within the respective cylinders 23. The angle of inclination of the wobble plate 55 with respect to the vertical line changes in response to the difference between the pressure within the cylinders 23 (the reaction force of the pistons 22) and the sum of the pressure within the crankcase 26 and the urging force of the coiled spring 33, which causes a change in the stroke length of the pistons 22.

The pressure control valve 60 is arranged in a diametrically central portion of the cylinder head 4 for controlling the pressure within the crankcase 26 to thereby control the angularity of the wobble plate 55. The pressure control valve 60 has a cylindrical casing 61 fitted to a bore 4a axially formed in the cylinder head 4 and a bore 21b formed in the cylinder block 21. The casing 61 has a portion 61a threadedly fitted through a front bore 21d formed in the cylinder block 21.

As shown in FIG. 3, the pressure control valve 60 is formed of an electromagnetic valve composed of a valve body 62 having a pressure receiving face 62a and disposed to open and close a port 21c formed in the cylinder block 21 along an axis thereof for communication between the suction chamber 41 and the crankcase 26 and to receive the pressure from the suction chamber 41, and an electromagnetic actuator 68 disposed to have its solenoid 63 energized by electric current of a magnitude based on parameter signals (signals representing various conditions from an insolation amount sensor, an air-mix damper position sensor, temperature sensors, etc.) and have a movable iron core 64 displaceable toward a stationary iron core 66 in response to a magnetic attracting force created by the energized solenoid 63 as well as by the force of a coiled spring 65 urging the movable iron core 64, to thereby control the opening of the valve body 62 via a transmission rod 67, thereinafter referred to. The opening of the valve body 62, when the solenoid 63 is not energized, is determined by the spring force (the sum of the urging force of the coiled spring 65 and the shrinking force of bellows 78, hereinafter referred to) and the pressure within the suction chamber 41. (Normally the valve body 62 is open because the valve opening force is greater than the valve closing force.) When the solenoid 63 is energized, the opening of the valve body 62 is determined by the pressure within the suction chamber 41 and the magnetic attracting force created by the stationary iron core 66 as a function of the value of electric current supplied to the solenoid 63.

The transmission rod 67, situated between the valve body 62 and the movable iron core 64, as described above, has functions of transmitting the amount of displacement of the valve body 62 to the movable iron core 64 and vice versa, and at the same time limiting the movement of the movable iron core 64 such that a predetermined small clearance x is secured between the movable iron core 64 and the stationary iron core 66 when the movable iron core 64 is attracted closest to the stationary iron core 66. The transmission rod 67 is composed of an iron core-side rod 67a situated on the side of the stationary iron core 66, a valve-side rod 67b situated on the side of the valve body 62, and a connection rod 67c connecting them. The connection rod 67c has its one end force fitted in a bore 67d formed in the iron core-side rod 67a along an axis thereof and has the other end force fitted in a bore 67e formed in the valve-side rod 67b along an axis thereof, whereby the iron core-side rod 67a and the valve-side rod 67b are connected to each other. The iron core-side rod 67a is slidably fitted in a bore 66b formed in the stationary iron core 66 along an axis thereof, and the valve-side rod 67b is slidably fitted in a bore 69a formed in a support plate 69 along an axis thereof.

Formed in a front end portion of the casing 61 is a recess 61b, in which the support plate 69 and a valve body-containing bottomed cylinder 72 are fitted. The bellows 78 are secured by brazing (or soldering, etc.) at one end to the support plate 69 and at the other end to the valve body 62 such that the bellows 78 covers the valve-side rod 67b of the transmission rod 67, forming an integral assembly together with them.

The bottom wall 72a of the valve body-containing cylinder 72 abuts via a gasket 73 against a wall 21e of the cylinder block 21, which has a communication passage 21cformed therethrough. A hole 72b formed in the bottom wall 72a along an axis thereof communicates with the communication passage 21c. The valve body 62 is slidably fitted within the cylinder 72 for opening and closing the hole 72b. The refrigerant that has entered the cylinder 72 through the hole 72b flows into the suction chamber 41 via a passage (not shown) after being discharged through a plurality of holes 72c formed in the cylindrical wall of the cylinder 72.

The coiled spring 65 urging the movable iron core 64 has a spring seat 74 threadedly fitted on a stationary screw-threaded shaft 75 such that the fitting seat 74 is adjustable in axial position to thereby adjust the spring force.

In FIG. 3, reference numeral 76 designates an O-ring hermetically fitted between the casing 61 and the support plate 69 for sealing therebetween, and reference numeral 77 designates a cable by way of which electric current is supplied to the solenoid 63.

Figure 5:
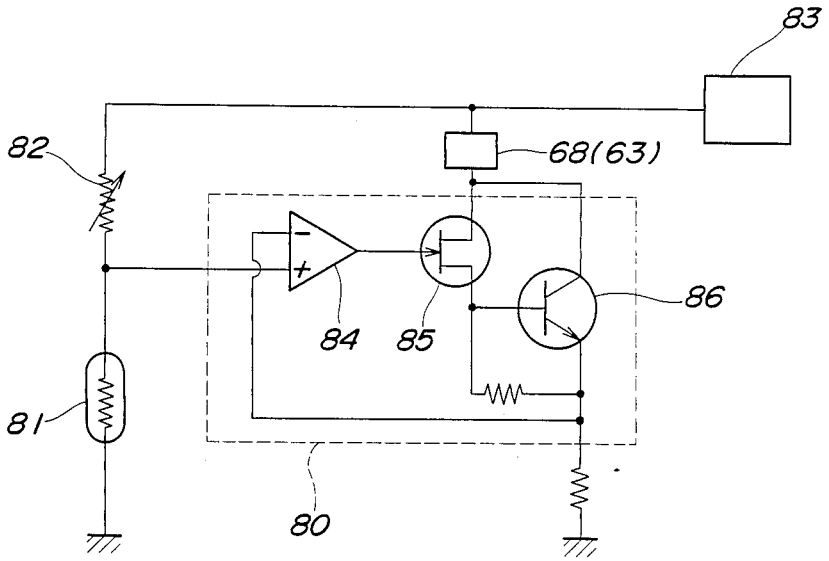
FIG. 5 is a circuit diagram showing an electric current control circuit according to a first embodiment of the invention.

FIG. 5 shows an electric current control circuit valve 60, according to a first embodiment of the invention. A temperature sensor 81 is formed of a thermistor for detecting a thermal load on the air conditioning system, such as fresh air temperature, and a temperature in a high pressure region in the refrigerating cycle, e.g. condenser temperature. The temperature sensor 81 is serially connected to a temperature setting device 82 provided in the passenger compartment and formed of a variable resistor for manually setting a desired blown air temperature. The temperature setting device 82 is connected to a constant-voltage power source 83. A comparator 84 of the electric current control circuit 80 has its non-inverting input terminal connected to the junction of the temperature sensor 81 with the temperature setting device 82. The electric current control circuit 80 is composed of the comparator 84, an FET 85, and a transistor 86. The solenoid 63 of the electromagnetic actuator 68 of the pressure control valve 60 is connected between the source of the FET 85 and the collector of the transistor 86, and the constant-voltage power source.

Let it be assumed that if, with the temperature setting device 82 set to, for instance, the maximum cooling position, the angularity of the wobble plate 55 of the compressor, i.e. the capacity of the compressor is set such that the suction pressure becomes an appropriate pressure such as 1.8 kg/cm$^2$.G at a medium value of the thermal load, then the compressor operates with the evaporator boiling pressure at the evaporator outlet port being 2.0 kg/cm$^2$.G and the evaporator boiling temperature being about 0° C. (The pressure loss between the compressor and the evaporator, which is given as a function of the flow rate of refrigerant, is 0.2 kg/cm$^2$.G.)

Under this condition, as the thermal load decreases, that is, as the temperature corresponding to the thermal load (fresh air temperature or condenser temperature) decreases, the resistance in the temperature sensor 81 increases so that the voltage applied to the comparator 84 increases, which in turn increases the conductivity of the transistor 86 in the electric current control circuit 80, causing an increase in the electric current flowing through the solenoid of the electromagnetic actuator 68. As a result, the opening of the valve body 62 decreases, thereby causing an increase in the pressure within the crankcase 26, which results in a decreased angularity of the wobble plate 55 and hence a decreased capacity. Therefore the suction pressure increases, for example to 1.9 kg/cm$^2$.G, and the flow rate of refrigerant also decreases accompanied by a decrease in the pressure loss between the suction port of the compressor and the outlet port of the evaporator, e.g. to about 0.1 kg/cm$^2$.G. As a result, the compressor is operated with the evaporator boiling pressure being 2.0 kg/cm$^2$.G and the evaporator boiling temperature being about 0° C.

On the other hand, when the thermal load increases, that is, when the temperature corresponding to the thermal load increases, the resistance in the temperature sensor 81 decreases with the result that the input voltage to the comparator 84 decreases, whereby decreased electric current flows through the solenoid 63 of the electromagnetic actuator 68 to thereby cause an increase in the opening of the valve body 62. As a result, the pressure within the crankcase 26 decreases, causing an increase in the capacity of the compressor, which in turn leads to a decrease in the suction pressure, e.g. to 1.7 kg/cm$^2$.G, and the flow rate of refrigerant increases accompanied by an increase in the pressure loss to about 0.3 kg/cm$^2$.G, whereby the evaporator boiling pressure becomes 2.0 kg/cm$^2$.G and the evaporator boiling temperature 0° C.

As described above, according to the invention, the opening of the electromagnetic valve is corrected such that the evaporator boiling pressure is always kept constant so long as the temperature setting device 82 is set to a constant desired temperature value, by controlling the suction pressure so as to vary in response to change in the thermal load, thus making it possible to prevent excessive cooling such as freezing of the evaporator which entails a loss in the compressor driving energy and occurs when the evaporator boiling pressure decreases as a result of decreased thermal load, and also to prevent insufficient cooling which occurs when the evaporator boiling temperature increases as a result of increased thermal load. Therefore, it is possible to always maintain a desired cooling condition in the passenger compartment.

On the other hand, in the electric current control circuit 80, when the movable iron core 64 and the transmission rod 67 slide in response to energization of the solenoid 63, they receive friction from peripheral parts they slide on, so that there occurs a hysteresis phenomenon in the displacement of the movable iron core 64 and the transmission rod 67 between the time the electric current energizing the solenoid 63 of the electromagnetic actuator 68 increases and the time the same decreases. Such hysteresis phenomenon is such that the opening defined between the passage 21*c* and the valve body 62 displaced by the movable iron core 64 via the transmission rod 67 is not a one-to-one function of the electric current energizing the electromagnetic actuator 68.

Figure 6:
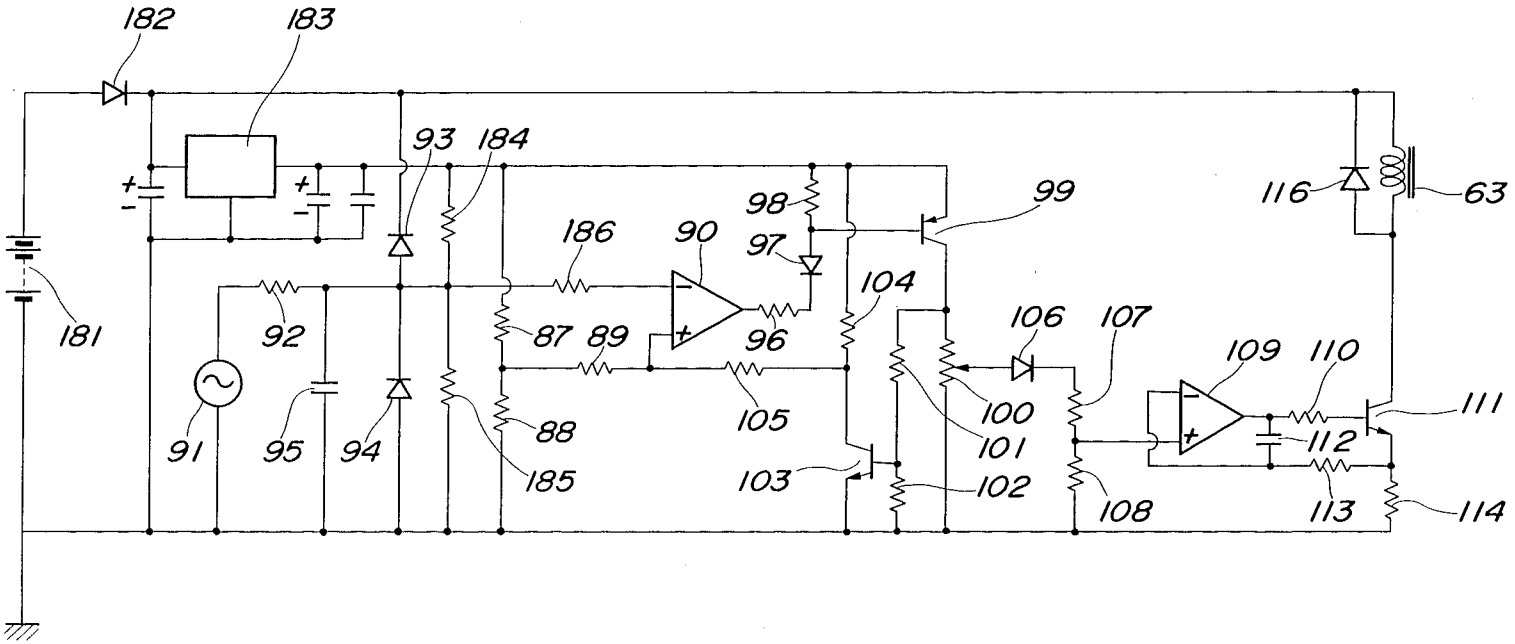
FIG. 6 is a circuit diagram showing an electric current control circuit according to a second embodiment of the invention.

FIG. 6 shows an electric current control circuit for controlling the solenoid 63 of the electromagnetic actuator 68 according to a second embodiment of the invention, which is capable of eliminating the above-mentioned hysteresis phenomenon. Reference numeral 181 designates a power source such as a battery, which is connected to a constant-voltage circuit 183 via a protective diode 182 for prevention of reverse voltage. The output voltage of the constant-voltage circuit 183 is divided by resistances 184 and 185, and the divided voltage is supplied via a resistance 186 to an inverting input terminal of the comparator 90 constituting pulse conversion means. Further, the output voltage of the constant-voltage regulator circuit 183 is divided by resistance 87 and 88, and the divided voltage is supplied via a resistance 89 to a non-inverting input terminal of the comparator 90. A triangular wave generator 91 is adapted to generate triangular pulses supplied to the junction of the resistances 184 and 185 via a resistance 92, and the same junction is also connected with the junction of constant-voltage regulating diodes 93 and 94. The cathode of the constant-voltage regulating diode 93 is connected to the cathode of the diode 182, and further the anode of the constant-voltage regulating diode 94, together with terminals of the triangular wave generator 91 and a capacitor 95, and the cathode of the power source 181 is grounded. The other terminal of the capacitor 95 is connected to the junction of the resistances 92 and 186.

An output terminal of the comparator 90 is connected to an output terminal of the constant-voltage regulator circuit 183 via a resistance 96, a reverse current preventive diode 97, and a resistance 98. The junction of the resistance 98 and the diode 97 is connected to the base terminal of a PNP type transistor 99, which has its emitter connected to an output terminal of the constant-voltage regulator circuit 183 and has its collector connected to a terminal of a variable resistor 100 as level conversion means with the other end grounded. Connected in series between the collector of the transistor 99 and ground are resistances 101 and 102, the junction of which is connected to the base of an NPN type transistor 103. The emitter of the transistor 103 is grounded and the collector thereof is connected via a resistance 104 to the output terminal of the constant-voltage regulator circuit 183 and also connected via a resistance 105 to a non-inverting input terminal of the comparator 90.

The output terminal of the variable resistor 100 is grounded via a reverse current preventive diode 106 and resistance 107 and 108. The junction of the resistances 107 and 108 is connected to a non-inverting input terminal of an operational amplifier 109, which constitutes a differential amplifier. An output terminal of the operational amplifier 109 is connected to the base of an NPN type transistor 111 via a resistance 110, and the emitter of the transistor 111 is grounded via a resistance 114 and connected to an inverting input terminal of the operational amplifier 109 via a resistance 113. The output terminal and the inverting input terminal of the operational amplifier 109 are connected to each other via a capacitor 112. Connected between the collector of the transistor 111 and the cathode of the diode 82 are the solenoid 63 and a diode 116 for prevention of reverse voltage generation, which are connected in parallel with each other.

Next, the operation of the control circuit of FIG. 6 will be described with reference to FIG. 7.

Figure 7:
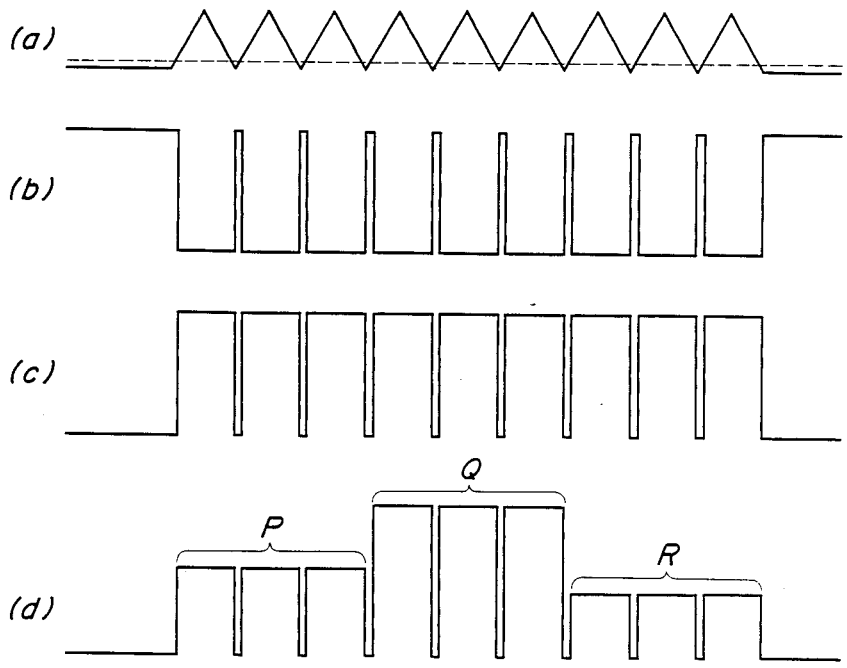
FIG. 7 is a timing chart showing waveforms of signals at essential portions in the circuit of FIG. 6.

Waveforms of output pulses from the triangular wave generator 91 are shown at (a) of FIG. 7. In FIG. 7 the abscissa represents the lapse of time and the ordinate the amplitude of pulses. While a triangular wave output [indicated by the solid line at (a) of FIG. 7] having a predetermined frequency is supplied to the inverting input terminal of the comparator 90 from the triangular wave generator 91, voltage having a constant level [indicated by the broken line at (a) of FIG. 7] is supplied to the non-inverting input terminal of the comparator 90. Therefore, the comparator 90 generates at its output terminal output pulses having a constant amplitude and a predetermined duty ratio [(b)of FIG. 7], whereby the collector current from the transistor 99 present a waveform shown at (c) of FIG. 7. Incidentally, the transistor 103 is for prevention of chattering in the output from the comparator 90.

The variable resistor 100 is controlled, by means of a microcomputer, not shown, in response to a parameter representing a thermal load on the air conditioning system (e.g. fresh air temperature, a temperature in a high pressure region in the refrigerating cycle, for example the temperature of the condenser). Shown at (d) of FIG. 7 is the waveform of the output generated by the variable resistor 100 as the slider thereof is consecutively displaced to three different positions. In response to the set three positions of the slider, the variable resistor 100 outputs waveform groups P, Q, and R being different in amplitude, respectively. For simplicity, each waveform group is illustrated in the form of only three pulses. The output from the variable resistor 100 is supplied to the non-inverting input terminal of the operational amplifier 109, which in turn supplies pulsive output to the transistor 111, whereby the transistor 111 is energized by each output pulse from the amplifier 109 to supply its collector current, as driving current, to the solenoid 63 of the electromagnetic actuator 68 of FIG. 3 to thereby energize the solenoid 63. This driving current is pulsive current having a constant duty ratio and having pulse amplitude varied in response to the output from the variable resistor 100. The operational amplifier 109, the transistor 111, etc. constitute driving means for driving the electromagnetic actuator 68.

Next, referring to FIG. 8, the operation of the pressure control valve 60 with the pulsive current supplied to its electromagnetic actuator 68 will be described.

Figure 8:
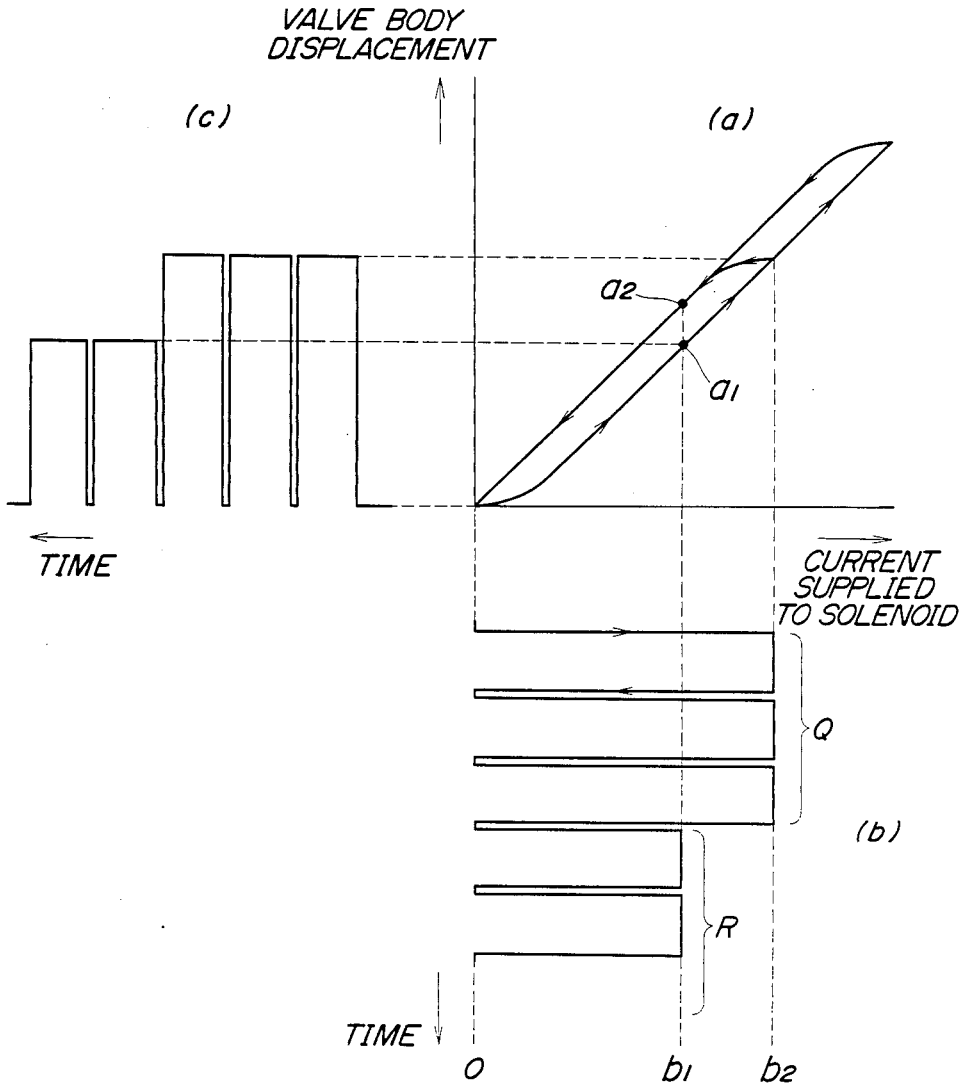
FIG. 8 is a graph showing the relationship between driving current supplied from the circuit of FIG. 6 to a solenoid of the pressure control valve and displacement of the valve body.

As already stated, when the movable iron core 64 and the transmission rod 67 slide in response to energization of the solenoid 63, they receive friction from the peripheral parts they slide on, and as a result there occurs a hysteresis phenomenon, as shown at (a) of FIG. 8, in the displacement of the movable iron core 64 and the transmission rod 67, i.e. in the displacement of the valve body 62 connected to the transmission rod 67. More specifically, the displacement of the valve body 62 taking place in response to the same current energizing the solenoid 63 differs between the time the current is increasing and the time the same is decreasing.

(b) of FIG. 8 shows the waveform of the amplified driving current which corresponds to the waveform shown at (d) of FIG. 7 and supplied to the solenoid 63, and (c) of FIG. 8 the displacement of the valve body 62 caused by the driving current. The waveform groups Q and R at (b) of FIG. 8 correspond, respectively, to the waveform groups Q and R at (d) of FIG. 7. Pulsive current supplied to the solenoid 63 has such a frequency and/or a duty ratio that there is no substantial response delay of the valve body 62 to pulses of the current, that is, the valve body 62 can be moved to a position of substantially zero displacement when the current falls to zero level, as shown at (c) of FIG. 8. For example, the frequency should be from several HZ to 20 Hz, and the duty ratio is from 90 to 99 %.

When the output voltage from the variable resistor 100 is changed, for example decreased, due to a change in the thermal load, whereby the pulse amplitude of the current supplied to the solenoid 63 is reduced, that is, when the pulse amplitude is decreased from a level b2 to a level b1, as shown at (b) of FIG. 8, the current supplied to the solenoid 63 falls to zero from the level b2 and immediately then rises to the level b1 so that the valve body 62 is displaced from a position corresponding to the pulse base to a position a1 corresponding to the pulse peak b1 instead of a position a2 shown at (a) of FIG. 8. Therefore, the above-described hysteresis phenomenon does not occur, and the displacement of the valve body 62 accurately corresponds to the increasing current valve supplied to the solenoid 63.

Therefore, it is always possible to control the pressure control valve with accuracy, and further it is possible to electronically control the pulse amplitude of the driving current by means of a microcomputor, etc. on the basis of various parameter values representing the thermal load on the air conditioning system, such as the fresh air temperature and the temperature of the condenser, whereby it is possible to obtain the optimal capacity of the compressor to operating conditions of the air conditioning system.

Incidentally besides a parameter representing the thermal load, the variable resistor 100 may have its output voltage controlled by the driver's manual operation, or by means of electronic control means such as a microcomputor using other parameters representing the operation of the air conditioning system such as the temperature of the evaporator and the temperature of the passenger compartment.

What is claimed is:

1. A system for controlling the capacity of a variable capacity wobble plate compressor for an air conditioning system, said compressor having a crankcase, a wobble plate arranged within said crankcase, pistons disposed for reciprocating motion through a stroke determined by the angularity of said wobble plate, a suction chamber, a communication passage for communicating said suction chamber with said crankcase, and a pressure control valve having a valve body disposed to open and close said communication passage and an electromagnetic actuator for controlling the opening of said valve body, said valve body having a hysteresis in displacement thereof with respect to the direction of change in a current value supplied to said electromagnetic actuator, wherein the capacity of said compressor is controlled in a manner such that the degree of communication between said suction chamber and said crankcase is controlled in response to the opening degree of said pressure control valve to vary pressure within said crankcase for varying the angularity of said wobble plate and hence vary the stroke of said pistons to thereby vary the capacity of said compressor, said system comprising: signal generating means for generating an output signal having a predetermined frequency; pulse conversion means for converting said output signal from said signal generating means into output pulses having a constant amplitude and a predetermined duty ratio; level conversion means for setting the amplitude of said output pulses from said pulse conversion means to a value corresponding to the value of a parameter representing a thermal load on the air conditioning system; and driving means for supplying said electromagnetic actuator with driving output pulses corresponding to output from said level conversion means, said driving output pulses assuming one extreme value and another extreme value, at one of which said extreme values said valve body of said pressure control valve assumes approximately zero displacement, at least one of said predetermined frequency and said predetermined duty ratio having a valve causing said valve body of said pressure control valve to be moved to a position of approximately zero displacement when said driving output pulses change from the other of said extreme values to said one thereof.

* * * * *